United States Patent [19]

Vits

[11] 4,263,724

[45] Apr. 28, 1981

[54] TRAVELING WEB DRYING APPARATUS

[75] Inventor: Hilmar Vits, Leichlingen, Fed. Rep. of Germany

[73] Assignee: Vits-Maschinenbau GmbH, Langenfeld, Fed. Rep. of Germany

[21] Appl. No.: 48,640

[22] Filed: Jun. 14, 1979

[51] Int. Cl.[3] ..... F26B 13/18

[52] U.S. Cl. ..... 34/62; 34/67; 34/114; 118/67; 118/69

[58] Field of Search ..... 68/5 D, 5 E; 118/60, 118/67, 69; 34/62, 66, 67, 159, 92, 114, 119, 124, 122

[56] References Cited

U.S. PATENT DOCUMENTS

| | | | |
|---|---|---|---|
| 273,013 | 2/1883 | Bedford | 34/62 |
| 1,144,896 | 6/1915 | Fosbraey | 34/62 |
| 2,157,388 | 5/1939 | MacArthur . | |
| 2,366,563 | 1/1945 | Shaw | 34/62 |
| 2,385,916 | 10/1945 | Hahn | 118/69 |
| 4,124,941 | 11/1978 | Birke et al. | 34/114 |

*Primary Examiner*—Larry I. Schwartz
*Attorney, Agent, or Firm*—Kenyon & Kenyon

[57] ABSTRACT

A freshly printed continuously traveling paper web leaves a heated print drying zone hot with its printing dry enough to avoid smudging but retaining a residual amount of the printing ink's solvent oil which continues to vaporize, forming a boundary layer of vaporizing oil traveling with the web. For cooling, the web wraps partially around one or more cooling rolls where condensation can cause the vapor boundary layer to condense on the exposed cold roll surface to a liquid phase, exerting a solvent action more or less resoftening the otherwise adequately dried printing with consequent smudging on the roll surface. To prevent this, the boundary layer is pneumatically removed from either this exposed surface of the roll not contacted by the web, or from the web itself, preventing resoftening of the printing by what would otherwise be liquid solvent oil.

8 Claims, 6 Drawing Figures

TRAVELING WEB DRYING APPARATUS

BACKGROUND OF THE INVENTION

Continuous production of a coated web often requires the web to be coated with a substance made liquid or semiliquid by including a volatile solvent. The freshly coated web is then passed through a heating zone where the solvent is driven off, after which the hot web is wrapped around one or more rotating cooling rolls and brought down to a temperature permitting further processing.

For example, when using the offset printing process for printing a continuously traveling paper web, the freshly printed web is continuously passed through a drying oven normally operated under sub-atmospheric pressure, or under-pressure, and where the ink's solvent oil is vaporized and removed to an extent normally permitting the web to be further processed without smudging of the ink. However, the hot printed web leaves the oven as a continuously traveling web with its printing containing a residual amount of the oil which continues to vaporize. If the oven temperature is raised enough to prevent this, the paper itself is undesirably dried of its natural moisture content. The web and its ink are hot and require cooling for further processing.

For compactness of the required cooling equipment, it is desirable to wrap the traveling web around a first cooling roll so that the web is traveling backwards and next around a second cooling roll in front of the first which provides further cooling and again reverses the travel of the web so it is again traveling forwardly. The web wraps only partially around each roll such as approximately somewhat over 180°, leaving the balance of the cold roll surface exposed.

The traveling web tends to carry the vapor of the still vaporizing residual solvent oil along on its surface in the form of a boundary layer conveyed by the web motion, and when this layer of vaporizing solvent oil contacts the exposed portions of the cooling rolls, it can condense to its liquid phase on the roll surfaces and cause a solvent or softening action on the otherwise adequately dried ink, resulting in smudging of the ink by one or the other of the rolls and a defective printed product. Heretofore, the only remedy was to raise the temperature of the drying oven with the undesirable consequence of excessively drying the paper itself so that it no longer retained its natural moisture content.

It is possible to use a normal drying oven temperature if the web leaving the oven is cooled in the form of a mechanically unsupported span, but this involves the use of equipment having an undesirable length. It is more desirable to use the two cooling rolls because this permits the use of shorter equipment.

In the present instance, the object is to provide an apparatus enjoying the compactness permitted by the cooling rolls while avoiding the ink smudging possibility described above.

SUMMARY OF THE INVENTION

According to the present invention, means are provided for pneumatically displacing the described boundary layer at such a position and such a rate as prevents it from contacting and condensing on the exposed surface portion of the roll or rolls with which the printing, or other coating, contacts. Preferably this means is provided for both rolls so that it is unimportant whether one or both sides of the traveling paper web carried the printing. As mentioned, the printing is customarily freed of its solvent oil by the oven dryer to a degree where there is no smudging risk if the printing is not resoftened by condensation of the vapor of the boundary layer the web carries along with it. The small amount of residual solvent remaining after drying normally evaporates off harmlessly. With the boundary layer of solvent oil vapor prevented from condensing on the exposed portions of the cooling rolls, there is no risk of the vapor condensing back to its liquid phase. Consequently, there can be no smudging of the ink by the web wrapping around these rolls for cooling.

The above means can be provided in a form blowing air or possibly some other gas, substantially radially against the exposed surface portions of the rolls, in each instance preferably by a perforated plate having a contour substantially corresponding to and coextensive with the exposed roll surface portion, with a housing back of the plate and adapted to be supplied with pressurized air. This constantly displaces the oil vapor, and to avoid it from contaminating the immediate environment, a suction hood is preferably positioned above the cooling rolls for collecting and removing the displaced vaporized or vaporizing oil.

In another form, the means can be for sucking the boundary layer from the web adjacent to the apex of the acute angle the web necessarily forms with the roll involved. In one form this means is a duct through which the web travels from the drying oven and having at its forward end a web exit nozzle adjacent to the mentioned apex, the nozzle having a declining top extending under the roll periphery towards the apex and forming a suction element. In this way the vapor is sucked from within the nip formed by the web with the roll. In another form, the suction means can be a perforated plate extending at an acute angle to the web from adjacent to the apex backwardly with respect to the web's traveling direction and provided with a suction box enclosing the back of the plate.

These and other possible forms of the invention are illustrated by the accompanying drawings and described in detail hereinafter.

DESCRIPTION OF THE DRAWINGS

The accompanying drawings are largely schematic to facilitate a ready understanding of the different forms of the invention they illustrate, the various figures being as follows.

DETAILED DESCRIPTION OF THE INVENTION

Figure 1:
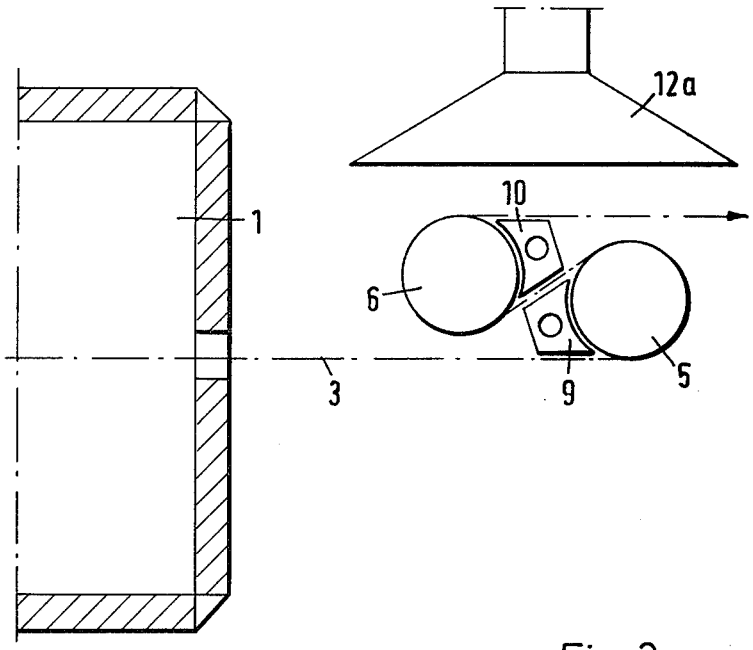
FIG. 1 in side elevation shows the back or exit end of the drying oven and the two cooling rolls in the case where the air is blown radially against the exposed roll surfaces.
Figure 3:
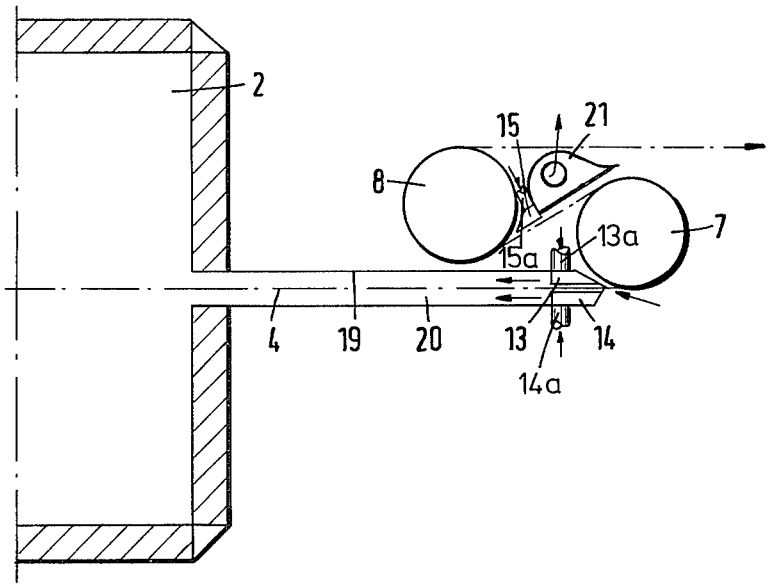
FIG. 3 is like FIG. 1 but shows the form of the invention wherein the air is blown backwardly from adjacent the apex of the acute angle the web forms with each roll.
Figure 4:
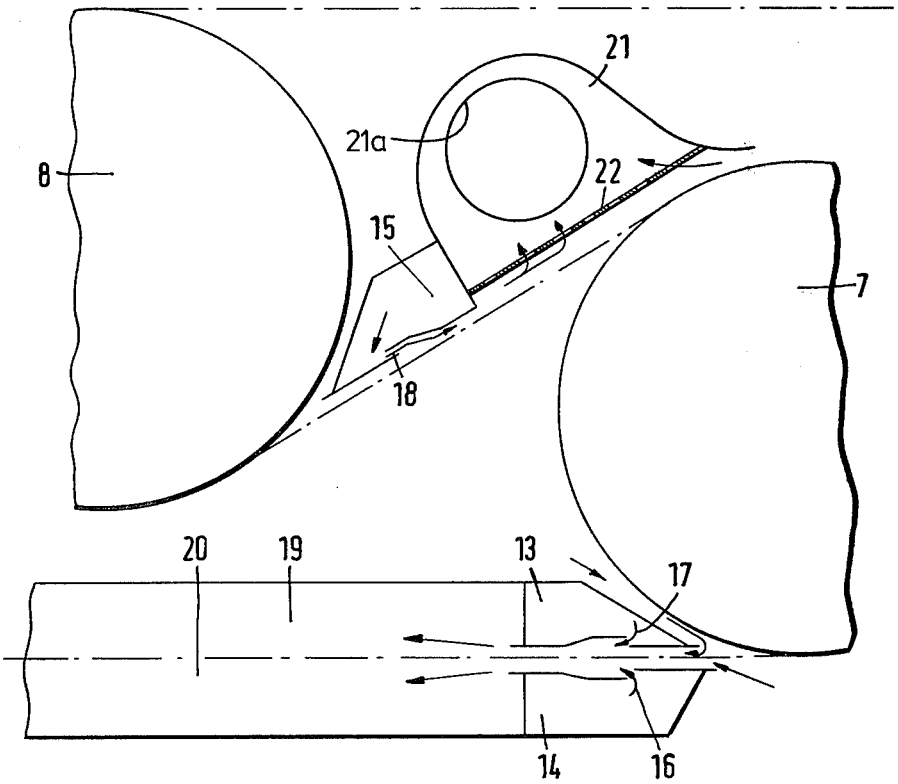
FIG. 4 shows the salient details of FIG. 3 on an enlarged scale.

The continuous drying oven shown at 1 in FIG. 1 and at 2 in FIG. 3 can be of the standard type, the freshly printed paper web 3 in FIGS. 1 and 4 in FIG. 3 being passed through the oven as a free span supported and guided by blasts of hot air, steam or gas which also provides the necessary heat for driving off the volatile solvent from the ink. The drying oven is provided with an exhaust which withdraws the vapor-laden atmosphere for disposal and causes the oven the operate below atmospheric pressure or at an under-pressure.

In FIG. 1 the cooling rolls are shown at 5 and 6, and are shown at 7 and 8 in FIG. 3. Using FIG. 1 as an example, the forwardly traveling web 3 wraps around the first cooling roll 5 so that the web is traveling backwards and next wraps reversely around the second cooling roll 6 which is in front of the roll 5 so as to again reverse with the web traveling forwardly again. From the side view the web travel path is in the form of the letter S lying on its side. Of necessity, at each roll the web wraps only partially around the roll, leaving a balance which is exposed because free from the wrapped web. The same explanation applies to FIG. 3. These cold roll stands are conventional, making it unnecessary to illustrate the manner in which the rolls are internally cooled and rotated. For the same reason, the internal details of the drying oven 1–2 are not illustrated.

Assuming that the paper web is freshly printed by the offset process, for example, or otherwise coated, the printing ink for its application includes a solvent which is volatile and largely driven off in the drying oven. With the drying temperature adjusted so that the paper web leaves the drying oven while satisfactorily retaining its natural moisture content, the printing is normally dry enough so that it can be passed around rolls and the like without smudging.

However, as previously explained, the printing ink contains a residual amount of its volatile oil solvent which through the retained heat of the web and printing continues to vaporize.

The continued vaporization of the residual solvent oil produces the boundary layer of vapor previously described, comprising vaporized oil solvent carried along by the traveling motion of the paper web and printing so as to reach the cooling rolls.

Assuming the web is printed on both sides, the boundary layer on top can reach the exposed cold surface of the first roll 5 or 7 while the boundary layer carried along by the bottom of the web can travel around this first roll to the exposed cold surface of the second roll. When this occurs, the cold roll surfaces can condense the vapor to its liquid phase and carry it to the initially adequately dried ink so as to resoften the ink and cause print smudging as the web passes around one or the other of the cooling rolls. This results in a smudged printed product which is, of course, unsatisfactory.

Figure 2:
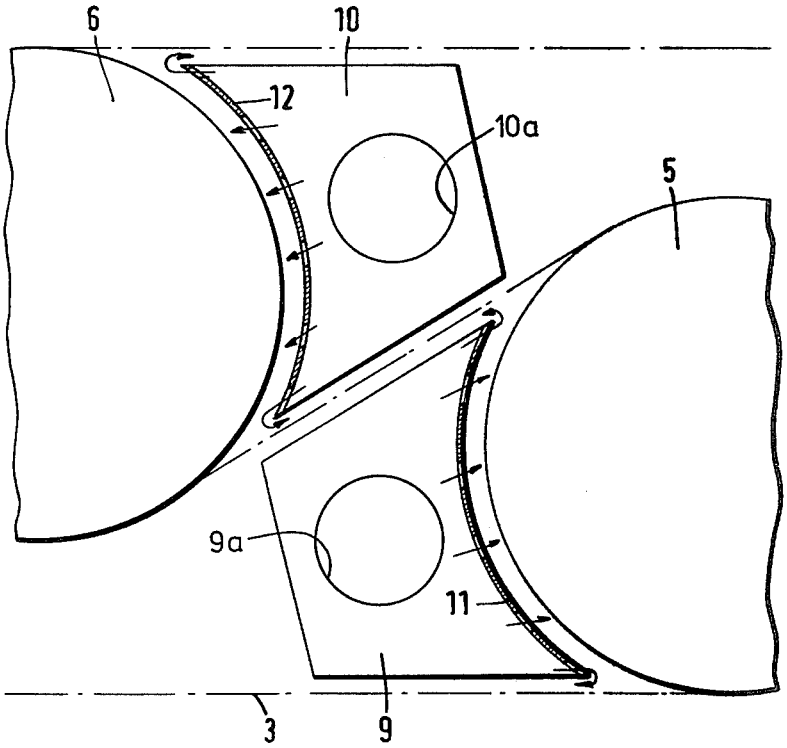
FIG. 2 is an enlargement taken from FIG. 1 and showing that form in more detail.

In FIGS. 1 and 2 housings 9 and 10 are provided with pressurized air inlets 9*a* and 10*a* and eject air through the orifices of perforated plates 11 and 12 each contoured to correspond to the contour of the exposed roll surface, the plates being transversely coextensive with the roll lengths. The design should be such that in each instance the oil vapor layer is displaced or driven away from the exposed roll surfaces at a rate preventing it from condensing on the exposed roll portion.

With this form the air is blown substantially radially against the exposed surface portion of the roll provided with the pneumatic vapor-displacement means. Preferably, the plates 11 and 12 are made coextensive not only with the length of the roll in each instance, but also with the segment of its surface that is exposed by being free from the wrapped web.

Collection of the vapor is effected by a suction hood 12*a* positioned above the rolled stand. This is advisable because an otherwise objectionable amount of vapor is displaced into the atmosphere around the installation.

With each of the rolls the web feeding tangentially to the roll forms an acute angle with the roll. In the form of FIGS. 1 and 2, the boundary layer is carried into the apex of this angle but is driven off from the roll surface before condensation can occur, time being required for the exchange of heat from the vapor to the cold roll surface. Unheated pressurized air can be used because the action is pneumatic in nature.

In FIGS. 3 and 4 the boundary layer is displaced directly from the web as it approaches each of the rolls. This is done by a lower nozzle through which the web travels to the first roll and which is formed by upper and lower chambers 13 and 14, respectively. The nose of this nozzle through which the web exits to the first roll, is tapered so it can extend well into the nip the web forms with the roll and adjacent to the apex of the acute angle formed by the web with the roll. In the case of the second roll 8 a correspondingly tapered nozzle 15 positioned in a generally corresponding manner blows a blast of air backwardly with respect to the web travel.

Suction is provided for the suction nozzle 13–14 by an aspirator formed by the slots 16 and 17, while in the case of the other nozzle the backwardly blowing orifice 18 ejects pressurized air. For the collection of the displaced vapor the nozzle 13–14 is connected with the drying oven 2 which normally operates at an under-pressure, via a closed conduit 20 through which the web travels to the first cooling roll, the aspirator discharge being counter to the web travel and via the space 20 is discharged back into the drying oven from which the atmosphere is constantly sucked for disposal.

In the case of the other nozzle 15, the backwardly displaced vapor is sucked upwardly by a suction box 21 having an inlet formed by a perforated plate 22 extending substantially parallel to the web leaving the first roll 7. The necessary pressure reduction of the suction box 21 can be effected via an outlet 21*a* by a power blower having its intake connected to the outlet 21*a* and its outlet connected to the two chambers 13 and 14 so as to provide a source of high velocity air for powering the aspirator 16–17, while at the same time getting rid of the vapor via the space 20 of the duct 19 which exhausts into the drying oven operating at an under-pressure. The inlets for the chambers 13 and 14 are shown at 13*a* and 14*a* in FIG. 3. The nozzle 15 receives its pressurized air via an inlet 15*a* shown in FIG. 3.

Although not shown, it would be possible to provide the suction box 21 with an exhaust blower discharging into a suction hood such as shown at 12*a* in FIG. 1, and to provide the lower nozzle aspirator from an individual source of pressurized air via the inlets 13*a* and 14*a*, the displaced vapor in this case being carried back to the oven dryer as previously described.

Figure 5:
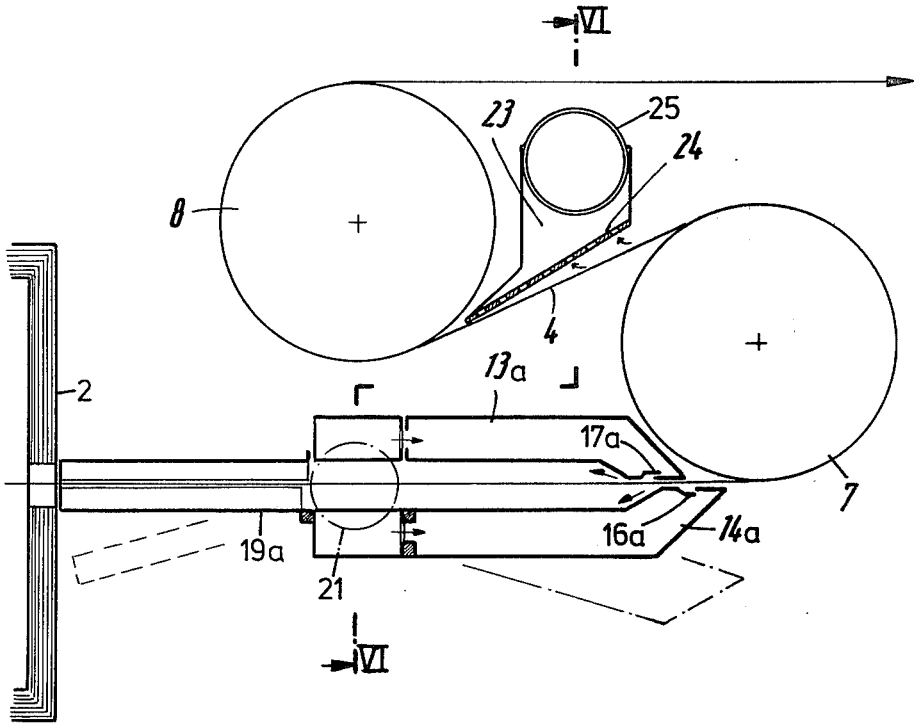
FIG. 5 is again like FIG. 1, but in this instance featuring an arrangement wherein a power blower is used with an intake drawing from one of the suction devices and an exhaust ejecting into the other which is provided with an aspirator receiving its jet power via this exhaust.
Figure 6:
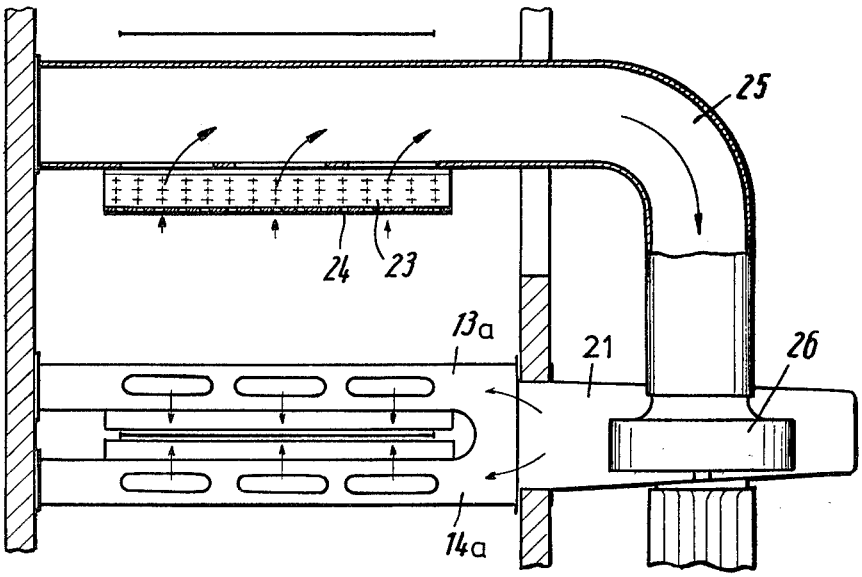
FIG. 6 is a vertical transverse section taken on the line VI—VI in FIG. 5.

In FIGS. 5 and 6 the nozzle for the first roll 7 is formed by upper and lower chambers 13*a* and 14*a* which correspond to the chambers 13 and 14 previously described, the aspirator elements being indicated at 16*a* and 17*a*. These parts largely correspond with those shown by the FIGS. 3–4 form.

However, in FIGS. 5 and 6 the suction box 23 for the upper surface of the span of web traveling between the two rolls operates entirely by suction. For this a suction box 23 is provided with an inlet in the form of a perforated plate 24, the suction box tapering so that the perforated plate 24 extends almost to the apex of the acute angle formed by the web with the second roll 8. Preferably the perforated inlet plate 24 is positioned at a sharply acute angle to the web span and extends for almost the length of the span as can be seen.

In this case the suction box 23 is connected by a pipe 25 with the input of a power blower or pump 26 which discharges via a conduit 27 into the upper and lower chambers 13*a* and 14*a* of the lower nozzle to provide the flow of pressurized air required to power the aspirators 16*a* and 17*a*, which then discharge all of the vapor from both nozzles back through the conduit 19*a* to the drying oven 2 somewhat as described before.

FIG. 6 serves to show that the suction box 23 and its inlet plate 24 and the chambers 13*a* and 14*a* of the lower nozzle extend transversely at least coextensively with the web width. This also applies to the generally corresponding parts of the other forms.

It can be seen that in all of the illustrative forms the boundary layer of vapor traveling with the web from the drying oven is displaced so that it cannot condense on the cold roll surfaces of the cooling rolls regardless of whether the web is printed or otherwise coated on one or both sides. The layer can be blown from the cold roll surfaces at a rate preventing condensates on those surfaces, or it can be sucked or blown away from the web itself adjacent to the line of initial contact the web makes with the roll in each instance, or it can be sucked away from the web surface itself.

What is claimed is:

1. Apparatus for removing a volatile solvent component of a coating on at least one side of a continuously traveling web, the apparatus comprising means through which the web travels for applying heat to the web to drive off a substantial amount of said component and from which the web travels forwardly hot and with its coating retaining at least a vaporizing residual part of the component forming a surface layer of vapor traveling with the web, a first cooling roll about which the web wraps so as to travel reversely and at least a second cooling roll in front of the first roll and about which the reversely traveling web wraps so as to again travel forwardly, in each instance the side of the web contacting the roll forming an acute angle with the roll and each roll having an exposed surface portion free from the web; wherein the improvement comprises means for pneumatically displacing the vapor of said layer at a position and rate preventing it from contacting and condensing on said portion of at least the one of said rolls with which said coating contacts.

2. The apparatus of claim 1 in which said means is for blowing a gas substantially radially against said exposed surface portion of said one of the rolls.

3. The apparatus of claim 2 in which said means is in the form of a perforated plate having a contour substantially corresponding to and coextensive with said exposed surface portion, and a housing for the back of the plate and adapted to be supplied with a pressurized gas.

4. The apparatus of claim 2 having a suction hood above said rolls for collecting and removing the displaced layer.

5. The apparatus of claim 1 in which said means is for sucking said layer from the web at least adjacent to the apex of the acute angle the web forms with said one of the rolls.

6. The apparatus of claim 5 in which said means is a perforated plate extending at an acute angle to the web from adjacent to the apex of the acute angle the web forms with said one of the rolls backwardly with respect to the web's travel, and a suction box enclosing the back of the plate.

7. The apparatus of claim 5 in which said one of the rolls is said first roll and said means is a duct through which the web travels and having a web exit nozzle adjacent to said apex, the nozzle having a declining top extending under the first roll towards the apex and forming a suction element.

8. The apparatus of claim 7 in which said duct extends backwardly and connects with an under-pressure.

* * * * *